US005752132A

United States Patent [19]

Hazama et al.

[11] Patent Number: 5,752,132

[45] Date of Patent: May 12, 1998

[54] PROCESS UNIT

[75] Inventors: Hiroyuki Hazama; Masaru Gotoh; Takashi Terada; Nobuhiro Nakajima; Hiroyuki Hamakawa; Nariaki Tanaka, all of Osaka, Japan

[73] Assignee: Mita Industrial Co., Ltd., Osaka, Japan

[21] Appl. No.: 857,306

[22] Filed: May 16, 1997

[30] Foreign Application Priority Data

May 31, 1996 [JP] Japan ..... 8-137310

[51] Int. Cl.[6] ..... G03G 21/18

[52] U.S. Cl. ..... 399/111; 399/107; 399/110

[58] Field of Search ..... 399/107, 110, 399/111, 113, 117; 358/300

[56] References Cited

U.S. PATENT DOCUMENTS 5,406,355 4/1995 Komuro et al. ..... 399/111

5,669,042 9/1997 Kobayashi et al. ..... 399/111

*Primary Examiner*—Arthur T. Grimley
*Assistant Examiner*—Hoan Tran
*Attorney, Agent, or Firm*—Beveridge, DeGrandi, Weilacher & Young, LLP

[57] ABSTRACT

A process unit comprising a photoconductor unit and a developing unit supported pivotably via a support shaft. The photoconductor unit and the developing unit each have a pair of support side walls having support holes formed on the same axis. One pair of the support side walls define a pair of inner support side walls having an outside width smaller than the inside width of the other pair of the support side walls, while the other pair of the support side walls define a pair of outer support side walls. The pair of outer support side walls and the pair of inner support side walls are supported via the support shaft passing through the respective support holes. One end of the support shaft is supported by one of the outer support side walls via a bearing member detachably mounted in the support hole of the one of the outer support side walls.

2 Claims, 4 Drawing Sheets

PROCESS UNIT

FIELD OF THE INVENTION

The present invention relates to a process unit which is mounted detachably on an image forming machine such as an electrostatic copier or a laser printer.

DESCRIPTION OF THE PRIOR ART

A typical example of a process unit of the above-mentioned type includes a photoconductor unit having a photoconductor drum on whose surface a latent electrostatic image is formed by an exposure means (the photoconductor unit constitutes an imaging unit); a developing unit having a development housing accommodating a developer (the developing unit constitutes another imaging unit), and a developing roller disposed in the development housing; and a support shaft means supporting the photoconductor unit and the developing unit pivotably relative to each other. The developing roller is disposed such that its surface is pressed against the surface of the photoconductor drum in a developing zone, thereby to supply in the developing zone a developer to a latent electrostatic image formed on the surface of the photoconductor drum. Also known is a process unit of the above-described type in which a cleaning unit (constituting still another imaging unit) is further supported via the support shaft means so as to be pivotable relative to the photoconductor unit and the developing unit.

In putting the aforementioned type of process unit to practical use, the following requirements have to be fulfilled in connection with supporting one imaging unit (a first imaging unit) and another imaging unit (a second imaging unit) via the support shaft means so as to be pivotable relative to each other: An operation for assembling the imaging units supported via the support shaft means should be easy, and their assembly should be firm and rattle-free.

SUMMARY OF THE INVENTION

The object of the present invention is to provide a novel process unit in which the first imaging unit and the second imaging unit can be assembled highly efficiently, and their assembly is firm and rattle-free.

The present invention provides a process unit including a first imaging unit, a second imaging unit, and a support shaft means for supporting the first imaging unit and the second imaging unit pivotably relative to each other; wherein the first imaging unit and the second imaging unit each have a pair of support side walls arranged with spacing and provided with support holes having a common axis, one pair of the support side walls define a pair of inner support side walls having an outside width smaller than the inside width of the other pair of the support side walls, while the other pair of the support side walls define a pair of outer support side walls, the support shaft means includes a support shaft composed of a rod member circular in section, and having a larger diameter portion, and having at one end part a smaller diameter portion continued from the larger diameter portion via a stepped portion; and a bearing member having a tubular portion provided with a support hole having an open end and a closed end, the bearing member being detachably mounted on one of the outer support side walls by the fitting of the tubular portion into the support hole of the one of the outer support side walls, and with the bearing member being mounted on the one of the outer support side walls, the respective support holes of the inner support side walls are fitted with the larger diameter portion of the support shaft, the support hole of the other of the outer support side walls is fitted with the smaller diameter portion of the support shaft, the support hole of the bearing member is fitted with the other end part of the support shaft, the outside surface of one of the inner support side walls is contacted with the inside surface of the other of the outer support side walls, the outside surface of the other of the inner support side walls is contacted with the open end of the bearing member or the inside surface of the one of the outer support side walls, the stepped portion of the support shaft is contacted with the inside surface of the other of the outer support side walls, and the end face of the other end part of the support shaft is positioned apart from the closed end of the bearing member.

According to the above invention, the support shaft composed of a rod member having a circular section is inserted, starting with its smaller diameter portion side, into the support hole of one of the outer support side walls, the support hole of the other of the inner support side walls, the support hole of one of the inner support side walls, and the support hole of the other of the outer support side walls in this order. Then, while inserting the tubular portion of the bearing member into the support hole of the one of the outer support side walls, the other end part of the support shaft is fitted into the support hole of the bearing member, thereby to mount the bearing member on the one of the outer support side walls. By this simple assembly operation, the first imaging unit and the second imaging unit can be supported via the support shaft so as to be pivotable relative to each other. Thus, the assembly operation for the first imaging unit and the second imaging unit is extremely easy.

Furthermore, in an assembled state in which the bearing member is mounted on the one of the outer support side walls, the respective support holes of the inner support side walls are fitted with the larger diameter portion of the support shaft, the support hole of the other of the outer support side walls is fitted with the smaller diameter portion of the support shaft, the support hole of the bearing member is fitted with the other end part of the support shaft, the outside surface of one of the inner support side walls is contacted with the inside surface of the other of the outer support side walls, and the outside surface of the other of the inner support side walls is contacted with the open end of the bearing member or the inside surface of the one of the outer support side walls. Thus, the movement, in the axial direction of the support shaft, of each of the inner support side walls relative to each of the outer support side walls is reliably restrained.

Moreover, in an assembled state in which the bearing member is mounted on the one of the outer support side walls, the stepped portion of the support shaft is contacted with the inside surface of the other of the outer support side walls, and the end face of the other end part of the support shaft is positioned apart from the closed end of the bearing member.

Thus, the support shaft is reliably prevented from slipping off in the axial direction. Hence, the first imaging unit and the second imaging unit can be assembled tightly without a rattle.

In addition to the foregoing constitution, the present invention provides a process unit in which the other end part of the support shaft is positioned in the support hole of the one of the outer support side walls via the tubular portion of the bearing member.

In this invention, one of the outer support side walls is supported by the other end part of the support shaft via the support hole of the one of the outer support side walls and the tubular portion of the bearing member. Thus, load on the one of the outer support side walls is securely supported by the other end part of the support shaft. Furthermore, excessive load on the tubular portion of the bearing member is avoided, and its deformation is prevented. Therefore, the required strength of the bearing member can be secured with its compactness realized. Since the bearing member can thus be made compact, the cost can also be reduced.

DETAILED DESCRIPTION OF THE PREFERRED EMBODIMENTS

An embodiment of a process unit of an image forming machine constructed in accordance with the present invention will be described in detail with reference to the accompanying drawings. In the illustrated embodiment, a printer will be taken as an example of the image forming machine equipped with the process unit constructed in accordance with the invention.

Figure 1:
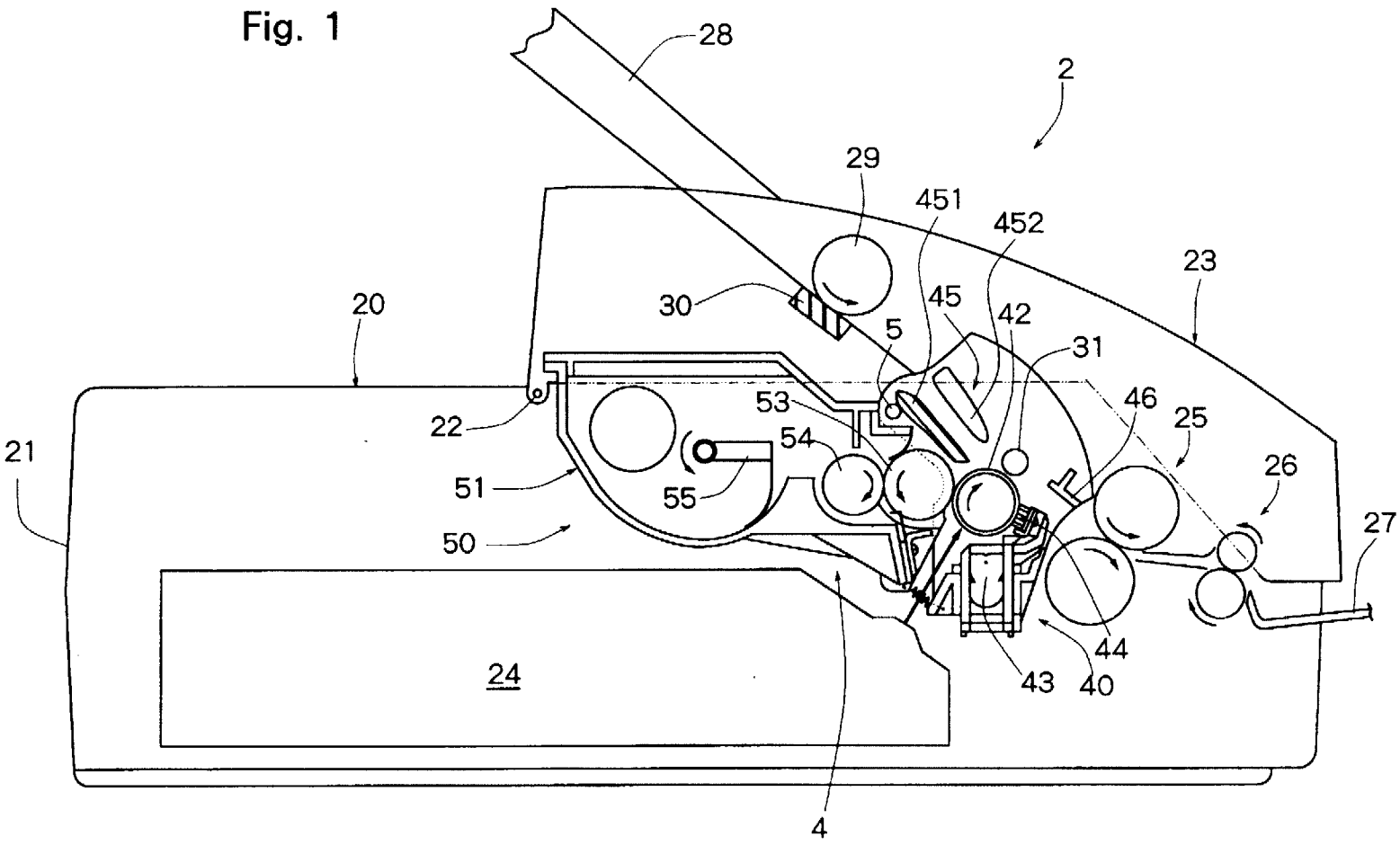
FIG. 1 is a front view schematically showing a printer on which an embodiment of a process unit constructed in accordance with the present invention is mounted.

FIG. 1 schematically shows a printer 2 on which an embodiment of the process unit constructed in accordance with the invention is mounted. In this embodiment, the printer 2 is a compact, slow-speed laser printer for use as a printer for a word processor, and has a machine housing 20 molded from a plastic material. This machine housing 20 includes an upwardly open box-shaped housing body 21, and a cover 23 mounted turnably on a shaft 22 disposed at the top of the housing body 21. At nearly the center of the machine housing 20 so constructed, a process unit 4 is mounted detachably.

Figure 2:
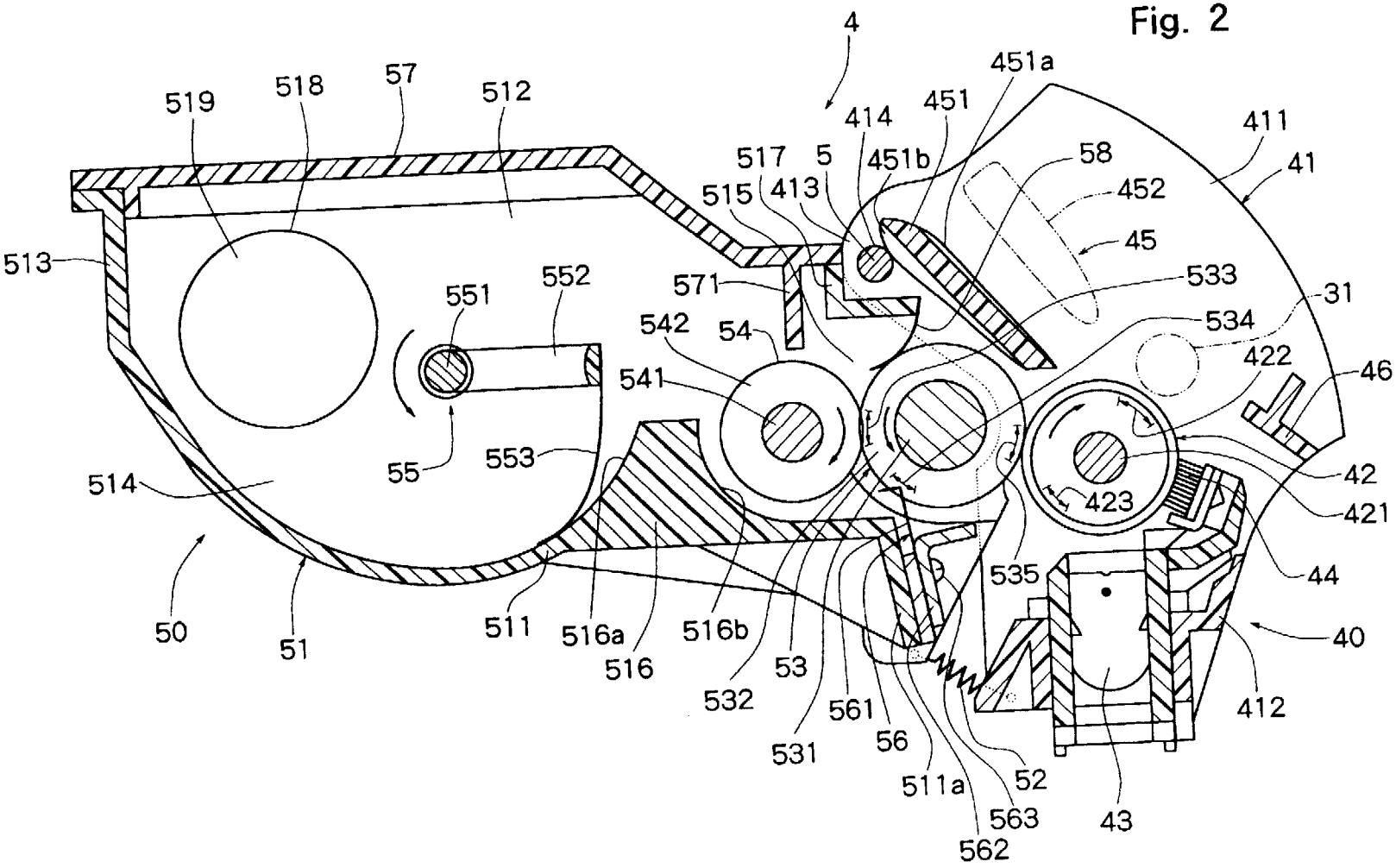
FIG. 2 is a sectional view of the process unit of FIG. 1.

The process unit 4, as shown in FIG. 2, has a photoconductor unit 40 (constituting a first imaging unit), and a developing unit 50 (constituting a second imaging unit), as a latent electrostatic developing device, which is supported pivotably relative to the photoconductor unit 40 via a support shaft 5 constituting a support shaft means. The photoconductor unit 40 has a photoconductor support means 41. The photoconductor support means 41 has a pair of side wall members 411 arranged with spacing in the back-and-forth direction (the direction perpendicular to the sheet face of FIG. 2) (only the rear side wall member is shown in FIG. 2), and a connecting member 412 which connects together lower parts of the pair of side wall members 411. The so constructed photoconductor support means 41 is integrally molded from a plastic material. At the upper end parts, on the developing unit 50 side, of the pair of side wall members 411, support side walls 413 having support holes 414 are integrally provided. The support shaft 5 is inserted into the support holes 414 provided in the support side walls 413. This support structure will be detailed later on.

The photoconductor unit 40 has a photoconductor drum 42 having a photosensitive layer on its peripheral surface. The photoconductor drum 42 has its rotating shaft 421 rotatably supported by the pair of side wall members 411 constituting the photoconductor support means 41, and rotationally driven by a drive means (not shown) in the direction of an arrow, i.e., such that its surface will move from below to above in a developing zone, the site of contact (the site of nip) with a developing roller (to be described later on) of the developing unit 50. On the connecting member 412 of the photoconductor support means 41, a charging corona discharger 43 is disposed opposite the lower peripheral surface of the photoconductor drum 42. Upstream from the charging corona discharger 43 in the direction of rotation of the photoconductor drum 42, a paper dust removing brush 44 is disposed in contact with the peripheral surface of the photoconductor drum 42.

Between the pair of side wall members 411 constituting the photoconductor support means 41, there is disposed a lower guide plate 451 constituting one of a pair of pre-transfer guide plates 45 for guiding a transfer sheet, which is fed from upper left in FIG. 2, toward a transfer zone 422 on the peripheral surface of the photoconductor drum 42. This lower guide plate 451 is molded integrally with the pair of side wall members 411. On the top surface of the lower guide plate 451, a plurality of guide ribs 451*a* are integrally molded with spacing in the longitudinal direction (the direction perpendicular to the sheet face of FIG. 2). On the bottom surface of the lower guide plate 451, too, a plurality of reinforcing ribs 451*b* are integrally molded with spacing in the longitudinal direction. These reinforcing ribs 451*b* are adapted to contact the support shaft 5. Thus, the lower guide plate 451 can be prevented from deflecting because of the contact of the reinforcing ribs 451*b* with the support shaft 5, even when a pressing force acts on the top surface of the lower guide plate 451 in an attempt to cause its deflection. The lower guide plate 451 can also function as a connecting member for connecting together the upper parts of the pair of side wall members 411 constituting the photoconductor support means 41, thereby improving the rigidity and strength of the photoconductor support means 41. In the illustrated embodiment, moreover, the lower guide plate 451 is molded integrally with the pair of side wall members 411, so that it can maintain a highly precise positional relationship with the photoconductor drum 42 supported rotatably on the pair of side wall members 411.

Between the pair of side wall members 411 constituting the photoconductor support means 41, a post-transfer guide plate 46 is disposed for guiding the transfer sheet, undergoing transfer in a transfer zone 422, to a fixing means to be described later on. The post-transfer guide plate 46 is molded integrally with the pair of side wall members 411. Thus, the post-transfer guide plate 46 can function as a connecting member for connecting together the pair of side wall members 411 constituting the photoconductor support means 41, thereby improving the rigidity and strength of the photoconductor support means 41.

Next, the developing unit 50 as a latent electrostatic image developing device will be described. The developing unit 50 in the illustrated embodiment has a development housing 51 accommodating a developer comprising a one-component toner. The development housing 51 is composed of a bottom wall 511, a front side wall 512 and a rear side wall 512 (only the rear side wall is shown in FIG. 2) erected upright from the front and rear ends of the bottom wall 511 (the ends in the direction perpendicular to the sheet face of FIG. 2), and a left side wall 513. These walls are integrally molded from a plastic material, defining an agitation chamber 514 and a development chamber 515. On the bottom wall 511 constituting the development housing 51, a partition wall 516 provided in the back-and-forth direction (the direction perpendicular to the sheet face in FIG. 2) is integrally molded between the agitation chamber 514 and the development chamber 515. The left and right surfaces of the partition wall 516 are formed as arcuate guide surfaces 516*a* and 516*b*. Between the front and rear side walls 512 constituting the development housing 51, a connecting member 517 disposed in an upper part on the development chamber 515 side is provided integrally with the front and rear side walls 512. In the rear side wall 512 constituting the development housing 51, a toner supply hole 518 is formed. The toner supply hole 518 is fitted with a cap 519.

In upper end parts, on the development chamber 515 side, of the front and rear side walls 512, support side walls 591 having support holes 592 (to be described later on with reference to FIGS. 3 and 4) are integrally provided. The support shaft 5 is inserted into the support holes 592 provided in the support side walls 591. This support structure will be detailed later on. Between a front end site of a lower end part of the photoconductor support means 41 of the photoconductor unit 40 and a rear end site of a lower end part of the development housing 51, coiled springs 52 are interposed as spring means. These coiled springs 52 urge the photoconductor unit 40 and the developing unit 50 toward each other about the support shaft 5. The development housing 51 is open upwards and rightwards, i.e., on the photoconductor unit 40 side.

Inside the development housing 51, a developing roller 53, a makeup roller 54, an agitating means 55 and a developer regulating means 56 are disposed. The developing roller 53 is disposed in the development chamber 515 of the development housing 51, and includes a rotating shaft 531 mounted rotatably on the front and rear side walls 512 constituting the development housing 51, and a solid synthetic rubber roller 532 secured to the outer peripheral surface of the rotating shaft 531. The rotating shaft 531 may be formed of a suitable metallic material such as stainless steel. The solid synthetic rubber roller 532 is composed of a relatively flexible and conductive material, e.g., conductive solid synthetic rubber such as urethane rubber. In the illustrated embodiment, the surface roughness of the peripheral surface of the solid synthetic rubber roller 532, i.e., the 10-point average roughness Rz defined in JIS B 0601, is set at 5.0 to 12.0. The volume resistivity of the solid synthetic rubber roller 532 is set at about $10^4$ to $10^9$ Ω.cm. The roller hardness of the solid synthetic rubber roller 532 is set at an Asker hardness of 60 to 80 in the illustrated embodiment.

The so constructed roller 532 of the developing roller 53 is exposed through the right-hand opening formed in the development housing 51, and positioned opposite the photoconductor drum 42. The peripheral surface of the roller 532 constituting the developing roller 53 is pressed against the peripheral surface of the photoconductor drum 42 in the developing zone. At the nip in this pressed condition, the peripheral surface of the roller 532 is compressed slightly elastically. The rotating shaft 531 of the developing roller 53 is rotationally driven by a drive means (not shown) in the direction of an arrow. That is, the developing roller 53 is rotationally driven so that its surface moves from below to above in the developing zone, the site of contact between the roller 532 and the photoconductor drum 42. In accordance with this rotation, the peripheral surface of the roller 532 is sequentially moved through a developer holding zone 533, a developer regulating zone 534, and a developing zone 535. In the illustrated embodiment, a constant voltage of 300V is applied to the rotating shaft 531 of the developing roller 53.

The makeup roller 54 is disposed parallel to the developing roller 53 inside the development chamber 515 of the development housing 51. The makeup roller 54 includes a rotating shaft 541 mounted rotatably on the front and rear side walls 512, and a roller 542 secured to the outer peripheral surface of the rotating shaft 541. The rotating shaft 541, like the rotating shaft 531 of the developing roller 53, may be formed of a suitable metallic material, such as stainless steel. The roller 542 is composed of a foam such as silicone foam or urethane foam. The roller 542 is pressed against the roller 532 of the developing roller 53 in the developer holding zone 533, the nip between the roller 542 and the developing roller 53. The hardness of the foam constituting the roller 542 of the makeup roller 54 is much smaller than the hardness of the roller 532 constituting the developing roller 53 (for example, an Asker hardness of about 35), and it is desirable that by being pressed against the roller 532 of the developing roller 53, the roller 542 be elastically compressed in the nip region by about 0.1 to 0.6 mm. The roller 542 also has conductivity, and its volume resistivity is set at about $10^2$ to $10^6$ Ω.cm. The rotating shaft 541 of the developing roller 54 is rotationally driven by a drive means (not shown) in the direction of an arrow, i.e., so that the roller surface moves from above to below in the developer holding zone 533, the nip between the roller 542 and the roller 532 of the developing roller 53. In accordance with this rotation of the rotating shaft 541, the roller 542 is also rotationally driven in the direction of the arrow. In the illustrated embodiment, a constant voltage of 450V, a higher voltage than the voltage applied to the developing roller 53, is applied to the rotating shaft 541 of the makeup roller 54.

The peripheral speed V1 of the photoconductor drum 42, the peripheral speed V2 of the developing roller 53, and the peripheral speed V3 of the makeup roller 54 are set in the relationship $V1<V2<V3$. In the illustrated embodiment, the relation between the peripheral speed V1 of the photoconductor drum 42 and the peripheral speed V2 of the developing roller 53 is set to be $1.2V1 \leqq V2 \leqq 2.5V1$, while the relation between the peripheral speed V2 of the developing roller 53 and the peripheral speed V3 of the makeup roller 54 is set to be $1.0 \leqq V2 \leqq V3 \leqq 2.0V2$. If the peripheral speed V2 of the developing roller 53 is less than 1.2V1, the supply of a developer to the photoconductor drum 42 will be insufficient, and the density of an image may lower. If the peripheral speed V2 of the developing roller 53 is less than 1.2V1, moreover, there will be a decline in the scraping action of the developing roller 53 on the non-transferred developer that adheres to the photoconductor drum 42 after transfer. Thus, the non-transferred developer cannot be removed from the photoconductor drum 42, potentially causing a so-called offset fog. If the peripheral speed V2 of the developing roller 53 is more than 2.5V1, on the other hand, the drive torque of the developing roller 53 will increase, possibly causing a scatter of the developer by a centrifugal force.

If the peripheral speed V3 of the makeup roller 54 is less than 1.0V2, moreover, there will be a weak scraping action of the makeup roller 54 on the peripheral surface of the developing roller 53. In case the non-transferred developer adhering to the photoconductor drum 42 after transfer adheres to the developing roller 53, therefore, this adherent developer will be difficult to remove. The adherent developer may generate a ghost in a subsequent development. If the peripheral speed V3 of the makeup roller 54 is more than 2.0V2, on the other hand, the drive torque of the makeup roller 54 will increase. Simultaneously, the developer will strongly tend to rest above the nip between the makeup roller 54 and the developing roller 53, possibly causing an insufficient supply of the developer to the developing roller 53.

In the agitation chamber 514 of the development housing 51, an agitating means 55 is disposed. The agitating means 55 is disposed parallel to the makeup roller 54, and includes a rotating shaft 551 mounted rotatably on the front and rear side walls 512 constituting the development housing 51, an agitating member 552 fixed to the rotating shaft 551, and an elastic agitating sheet member 553 mounted to the agitating member 552. The agitating member 552 is formed of a plastic material, and has a plurality of openings in the longitudinal direction (the direction perpendicular to the sheet face of FIG. 2). The agitating sheet member 553 is formed of a flexible, elastic material, such as polyethylene terephthalate (PETP), and is secured by an adhesive or the like to the front edge of the agitating member 552. The so constructed agitating means 55 is rotationally driven continuously by a drive means (not shown) in the direction of an arrow in FIG. 2.

The developer regulating means 56 has a flexible, elastic blade 561 to be pressed against the peripheral surface of the roller 532 constituting the developing roller 53. The blade 561 is composed of, say, a stainless steel plate or a spring steel plate about 0.1 to 0.2 mm thick, and has nearly the same longitudinal dimension as the length of the roller 532 constituting the developing roller 53. The blade 561 has a base end part mounted on a blade mounting portion 511*a* provided at the open end, on the photoconductor unit 40 side, of the bottom wall 511 constituting the development housing 51. That is, the base end part of the blade 561 is sandwiched between the blade mounting portion 511*a* and a press plate 562, and is fixed thereto by means of a machine screw 563. A front end part of the blade 561 is bent, and this bend is pressed against the peripheral surface of the roller 532 constituting the developing roller 53 in the developer regulating zone 534.

On the development housing 51, a closure 57 covering the open top of the development housing 51 is mounted. The closure 57 is composed of a plastic material, and is secured by an adhesive to the top surfaces of the front and rear side walls 512, the left side wall 513 and the connecting member 517 that constitute the development housing 51. On the inner surface of the closure 57, a regulating portion 571 is integrally molded which extends in the back-and-forth direction (the direction perpendicular to the sheet face of FIG. 2) at a position opposite the makeup roller 54, and which protrudes on the development chamber 515 side. Between the lower end of the regulating portion 571 and the outer peripheral surface of the roller 542 constituting the makeup roller 54, a predetermined spacing is provided. In the illustrated embodiment, the connecting member 517 constituting the development housing 51 is mounted with a sheet-like seal member 58. The sheet-like seal member 58 is composed of a flexible, elastic sheet member of, say, polyethylene terephthalate (PETP), and has nearly the same length as the axial length of the roller 532 constituting the developing roller 53. The sheet-like seal member 58 has one end part secured to the connecting member 517 by a securing means such as an adhesive, and has the other end part curved and elastically contacted with the peripheral surface of the roller 532 constituting the developing roller 53. The so constructed sheet-like seal member 58 prevents a scatter of the developer from the opening, on the photoconductor unit 40 side, of the development housing 51 in cooperation with the blade 561 of the developer regulating means 56.

Figure 3:
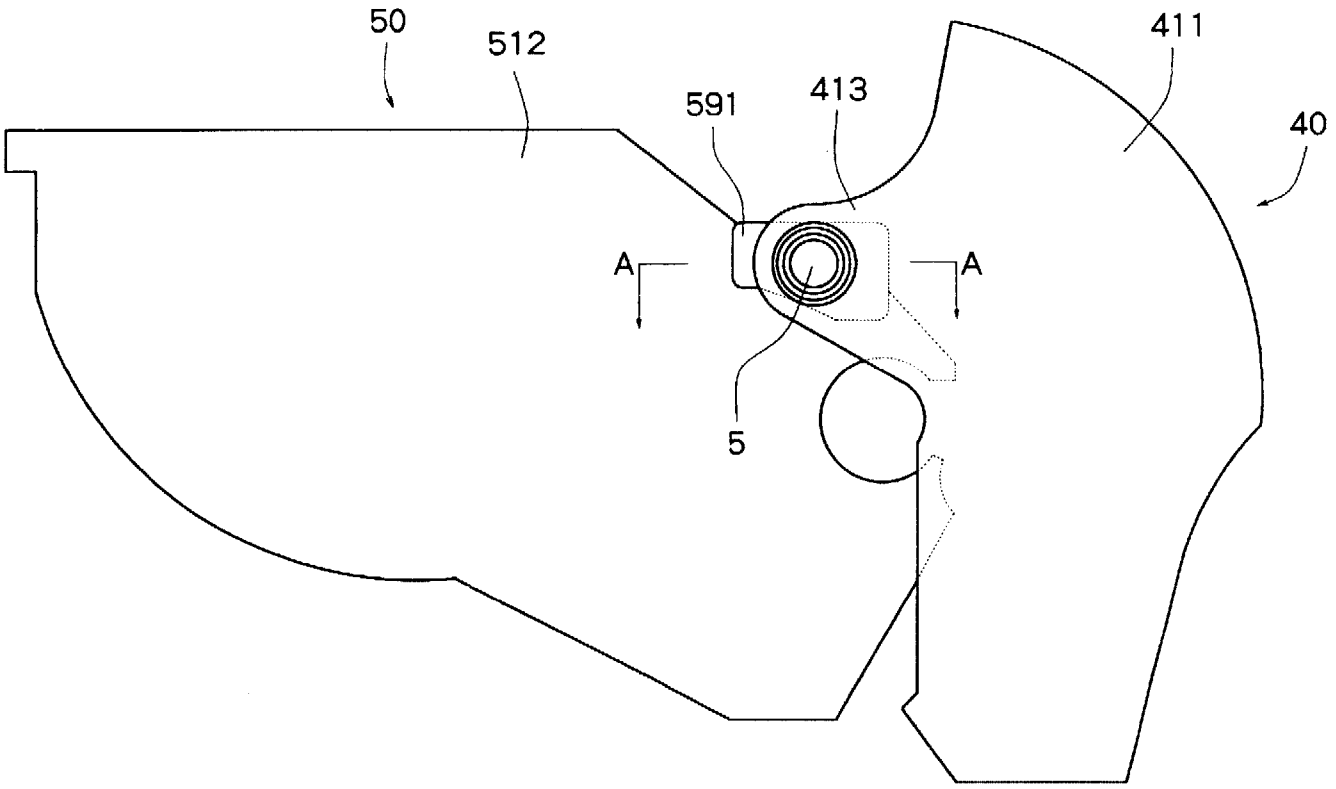
FIG. 3 is a schematic view showing the state of mounting of the photoconductor drum and the developing unit in the process unit of FIG. 2, as seen from the side.
Figure 4:
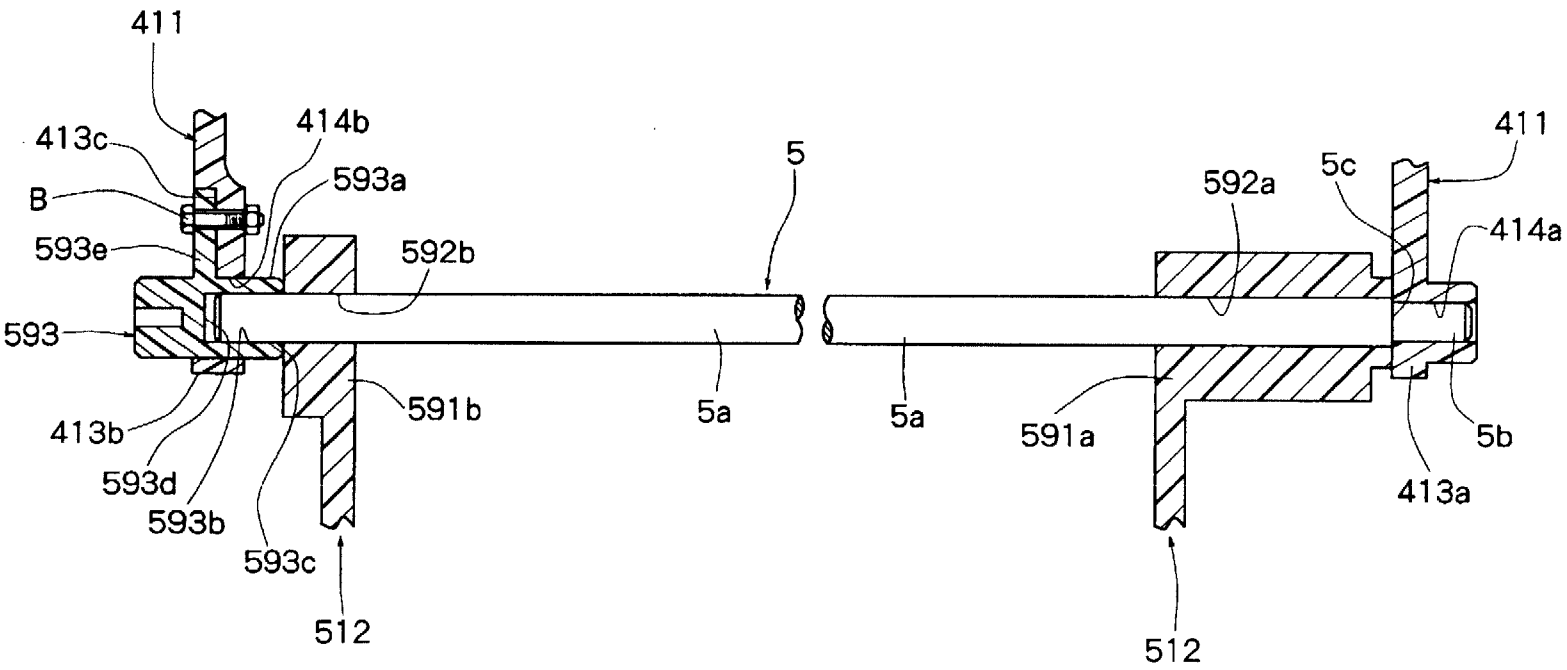
FIG. 4 is a sectional view taken on line A—A of FIG. 3.

A description will be given of a structure for supporting (connecting) the photoconductor unit 40 and the developing unit 50 constructed in accordance with the present invention. With reference to FIGS. 3 and 4, the photoconductor unit 40 has a pair of support side walls 413*a* and 413*b* arranged with spacing. The support side walls 413*a* and 413*b* are provided with support holes 414*a* and 414*b*, respectively, which have a common axis. Each of the support side walls 413*a* and 413*b* is formed integrally with the corresponding side wall member 411. The developing unit 50 has a pair of support side walls 591*a* and 591*b* arranged with spacing. The support side walls 591*a* and 591*b* are provided with support holes 592*a* and 592*b*, respectively, which have a common axis. Each of the support side walls 591*a* and 591*b* is formed integrally with the corresponding side wall member 512.

The pair of support side walls 591*a* and 591*b* define a pair of inner support side walls having an outside width (the maximum width in the right-and-left direction in FIG. 4) smaller than the inside width (the minimum width in the right-and-left direction in FIG. 4) of the pair of support side walls 413*a* and 413*b*. Thus, the pair of support side walls 413*a* and 413*b* define a pair of outer support side walls. In place of this constitution, there may be a constitution in which the pair of support side walls 591*a* and 591*b* define a pair of outer support side walls, while the pair of support side walls 413*a* and 413*b* define a pair of inner support side walls.

The support shaft 5 is composed of a metallic rod member circular in section, and has a larger diameter portion 5*a*, and has at one end part (right end part) a smaller diameter portion 5*b* continued from the larger diameter portion 5*a* via a stepped portion 5*c*. The rod member constituting the support shaft 5 may be formed of a material other than a metal, such as a plastic material. On the support side wall 413*b*, a bearing member 593 is mounted detachably. The bearing member 593 has a tubular portion 593*a*, which is provided with a support hole 593*b*. The support hole 593*b* has an open end 593*c* and a closed end 593*d*. The open end 593*c* defines the inside end of the tubular portion 593*a*. At nearly the center, in the axial direction, of the tubular portion 593*a*, a mounting flange 593*e* extending radially outwardly is formed. In the outer support side wall 413*b*, a receiving concave 413*c* is formed for receiving the mounting flange 593*e*. The bearing member 593 has its tubular portion 593*a* fitted into the support hole 414*b* of the outer support side wall 413*b*. Further, the mounting flange 593*e* is fitted into the receiving concave 413*c*, and secured to the outer support side wall 413*b* by means of a bolt B. Thus, the bearing member 593 is detachably mounted on the outer support side wall 413*b* (the state of FIG. 4).

As shown in FIG. 4, with the bearing member 593 being mounted on the outer support side wall 413*b*, the respective support holes 592*a* and 592*b* of the inner support side walls 591*a* and 591*b* are rotatably fitted with the larger diameter portion 5*a* of the support shaft 5. The support hole 414*a* of the outer support side wall 413*a* is rotatably fitted with the smaller diameter portion 5*b* of the support shaft 5. The support hole 593*b* of the bearing member 593 is rotatably fitted with the other end part (the left end part) of the support shaft 5. The outside surface (the right side surface) of the inner support side wall 591*a* is contacted with the inside surface (the left side surface) of the outer support side wall 413*a*. The outside surface (the left side surface) of the inner support side wall 591*b* is contacted with the open end 593*c* of the bearing member 593. The stepped portion 5*c* of the support shaft 5 is contacted with the inside surface (the left side surface) of the outer support side wall 413*a*. The end face of the other end part (the left end part) of the support shaft 5 is positioned apart from the closed end 593*d* of the bearing member 593. Instead of contacting the outside surface (the left side surface) of the inner support side wall 591b with the open end 593c of the bearing member 593, it is permissible to contact the outside surface (the left side surface) of the inner support side wall 591b directly with the inner side surface (the right side surface) of the outer support side wall 413b. The other end part of the support shaft 5 is positioned in the support hole 414b of the outer support side wall 413b via the tubular portion 593a of the bearing member 593.

The support shaft 5 is inserted, starting with its smaller diameter portion 5S side, into the support hole 414b of the outer support side wall 413b, the support hole 592b of the inner support side wall 591b, the support hole 592a of the inner support side wall 591a, and the support hole 414a of the outer support side wall 413a in this order, from left to right in FIG. 4. Then, while inserting the tubular portion 593a of the bearing member 593 into the support hole 414b of the outer support side wall 413b, the other end part of the support shaft 5 is fitted into fitted into the support hole 593b of the bearing member 593, thereby to mount the bearing member 593 on the outer support side wall 413b. By this simple assembly operation, the photoconductor unit 40 and the developing unit 50 can be supported via the support shaft 5 so as to be pivotable relative to each other.

Furthermore, in an assembled state in which the bearing member 593 is mounted on the outer support side wall 413b, the respective support holes 592a and 592b of the inner support side walls 591a and 591b are fitted with the larger diameter portion 5a of the support shaft 5, the support hole 414a of the outer support side wall 413a is fitted with the smaller diameter portion 5b of the support shaft 5, the support hole 593b of the bearing member 593 is fitted with the other end part of the support shaft 5, the outside surface of the inner support side wall 591a is contacted with the inside surface of the outer support side wall 413a, and the outside surface of the inner support side wall 591b is contacted with the open end 593c of the bearing member 593 or the inside surface of the outer support side wall 413b. Thus, the movement, in the axial direction of the support shaft 5, of each of the inner support side walls 591a and 591b relative to each of the outer support side walls 413a and 413b is reliably restrained. Moreover, in an assembled state in which the bearing member 593 is mounted on the outer support side wall 413b, the stepped portion 5c of the support shaft 5 is contacted with the inside surface of the outer support side wall 413a, and the end face of the other end part of the support shaft 5 is positioned apart from the closed end 593d of the bearing member 593. Thus, the support shaft 5 is reliably prevented from slipping off in the axial direction.

Besides, in an assembled state in which the bearing member 593 is mounted on the outer support side wall 413b, the other end part of the support shaft 5 is positioned in the support hole 414b of the outer support side wall 413b via the tubular portion 593a of the bearing member 593. In other words, the outer support side wall 413b is supported by the other end part of the support shaft 5 via the support hole 414b and the tubular portion 593a of the bearing member 593. Thus, load on the outer support side wall 413b is securely supported by the other end part of the support shaft 5. Furthermore, excessive load on the tubular portion 593a of the bearing member 593 is avoided, and its deformation is prevented.

The so constructed process unit 4 is mounted detachably on the machine housing 20 of the printer 2, as shown in FIG. 1. That is, the cover 23 constituting the machine housing 20 of the printer 2 is turned about the shaft 22 counterclockwise in FIG. 1, whereby the top of the housing body 21 constituting the machine housing 20 is opened. Then, the process unit 4 is mounted inside the housing body 21 from above. Inside the housing body 21, a positioning means (not shown) capable of placing the photoconductor unit 40 of the process unit 4 at a predetermined position is provided. After the process unit 4 is mounted inside the housing body 21 of the machine housing 20, the cover 22 is turned about the shaft 22 clockwise in FIG. 1 to close the top of the housing body 21.

As shown in FIG. 1, a laser unit 24 is disposed in a lower part of the housing body 21 constituting the machine housing 20 of the printer 2. This laser unit 24 throws laser light, corresponding to print data from, say, a word processor connected to the printer 2, upon the photosensitive layer of the photoconductor drum 42 in an exposure zone 423 of the process unit 4, thereby forming a latent electrostatic image. In the housing body 21 constituting the machine housing 20 of the printer 2, a fixing roller pair 25 is disposed downstream from the post-transfer guide plate 46. Downstream from the fixing roller pair 25, a discharge roller pair 26 is disposed. Furthermore, a copy receiving or discharge tray 27 is disposed downstream from the discharge roller pair 26.

On the cover 23 constituting the machine housing 20 of the printer 2, a feed tray 28 for bearing a transfer sheet is disposed at an upper left part in FIG. 2. Downstream from the feed tray 28, a feed roller 29 is disposed. This feed roller 29 is rotationally driven by a drive means (not shown) in the direction of an arrow in FIG. 2. Opposite the feed roller 29, a friction pad 30 for sheet separation is disposed. In the transfer zone 422, a non-contact transfer roller 31 is disposed opposite the photoconductor drum 42. The transfer roller 31 is formed of a conductive urethane foam, and rotatably supported on the cover 23. The transfer roller 31 has opposite end parts mounted with collars (not shown) which are composed of an insulating material, such as synthetic resin, and each of which has a larger outside diameter than the diameter of the transfer roller 31. These collars are disposed in contact with the peripheral surface of the photoconductor drum 42. Thus, the transfer roller 31 is caused to follow the rotation of the photoconductor drum 42 while slipping. The clearance between the peripheral surface of the transfer roller 31 and the peripheral surface of the photoconductor drum 42 is set at about 0.5 mm. A constant voltage of, say, 10 μA is applied to the so constructed transfer roller 31. On the cover 23, an upper guide plate 452 constituting the other component of the pre-transfer guide plate pair 45 is disposed.

The printer 2 in the illustrated embodiment is constructed as described above. Its actions will be described below.

Based on a print command from a word processor or the like (not shown), the above-described members start operation, and the photosensitive layer on the surface of the photoconductor drum 42 is charged substantially uniformly to a specific polarity by the charging corona discharger 43. Then, the laser unit 24 throws laser light, corresponding to the print data from the word processor or the like, upon the surface of the charged photosensitive layer of the photoconductor drum 42, thereby forming a latent electrostatic image there. The latent electrostatic image formed on the photosensitive layer of the photoconductor drum 42 is developed to a toner image by the developing action of the developing unit 50. The developing action of the developing unit 50 will be described in detail later on. Transfer sheets laid on the feed tray 28 are fed one by one by the action of the feed roller 29 and the friction pad 30. The fed transfer sheet is guided by the pre-transfer guide plate pair 45, and conveyed to the clearance between the photoconductor drum 42 and the transfer roller 31. Thus, the toner image formed on the photoconductor drum 42 is transferred to the surface of the transfer sheet. The transfer sheet having the toner image transferred thereto is guided by the post-transfer guide plate 46 to be carried to the fixing roller pair 25. The transfer sheet having the toner image heat-fixed by the fixing roller pair 25 is discharged onto the discharge tray 27 by the discharge roller pair 26.

The developing action of the developing unit 50 will be described. After the start of operation of the developing unit 50, the developing roller 53, makeup roller 54 and agitating means 55, are rotationally driven by drive means (not shown) in the directions of the arrows. In accordance with the rotation of the agitating member 552 and agitating sheet member 553, constituting the agitating means 55, in the direction of the arrow, the developer accommodated in the agitation chamber 514 is passed over the partition wall 516 while being agitated, whereafter the developer is fed into the development chamber 515 from above the makeup roller 54. On this occasion, the amount of the developer fed into the development chamber 515 is controlled by the regulating portion 571 formed on the inner surface of the closure 57 so that this amount will not be excessive. The developer so supplied by the agitating means 55 is borne on the roller 542 of the makeup roller 54, and carried to the nip between the roller 542 and the roller 532 of the developing roller 53, which is also the developer holding zone 533. The makeup roller 54 and the developing roller 53, as described above, rotate in the developer 35 holding zone 533, the nip, in the same direction, from above to below. Thus, the supply of the developer from the makeup roller 54 to the developing roller 53 is adequate, preventing lack of the developer. Since the makeup roller 54 and the developing roller 53, as described above, rotate in the same direction in the developer holding zone 533, the nip, moreover, they can be driven reliably without requiring a great drive force.

The developer sent to the developer holding zone 533, the nip between the makeup roller 54 and the developing roller 53, is conveyed toward the developer regulating zone 534 while being held on the peripheral surface of the roller 532 constituting the developing roller 53. At this time, the makeup roller 54 and the developing roller 53 rotate in the same direction, from above to below, in the developer holding zone 533, the nip, as described earlier. The developer also passes through the nip, remains held on the developing roller 53, and moves to the developer regulating zone 534 and the developing zone 535. When passing through the nip, the developer is fully rubbed against the makeup roller 54 and the developing roller 53 and fully charged, thus preventing the occurrence of a fog.

In the developer regulating zone 534, the blade 561 of the developer regulating means 56 acts on the developer held on the peripheral surface of the roller 532 of the developing roller 53 to restrict the developer held on the peripheral surface of the roller 532 to a required amount and form it into a thin layer. The developer, which has been regulated by the blade 561 of the developer regulating means 56 in the developer regulating zone 534 and scraped off onto the bottom wall 511 of the development housing 51, does not remain stationary, but is conveyed along the guide surface 516b of the partition wall 516, because the makeup roller 54 is rotated in the direction of the arrow.

As described above, the developer is held on the peripheral surface of the roller 532 constituting the developing roller 53 in the developer holding zone 533, and formed into a thin layer by the action of the blade 561 of the developer regulating means 56 in the developer regulating zone 534. Then, this developer is conveyed to the developing zone 535 in accordance with the rotation in the direction of the arrow. In the developing zone 535, the developer is applied to the latent electrostatic image on the electrostatic photoconductor disposed on the peripheral surface of the photoconductor drum 42, whereby the latent electrostatic image is developed to a toner image. For example, the latent electrostatic image has a non-image area charged to about +600V, and an image area charged to about +120V, and a toner as the developer is caused to adhere to the image area (reversal development). The photoconductor drum 42 and the developing roller 53 are rotationally driven in the directions of the arrows in FIG. 2. In the developing zone 535, therefore, the peripheral surface of the photoconductor drum 42 and the peripheral surface of the roller 532 constituting the developing roller 53 are both moved in the same direction, from below to above. Since the peripheral speed V2 of the roller 532 and the peripheral speed V1 of the photoconductor drum 42 are set in the relationship $1.2V1 \leqq V2 \leqq 2.5V1$, a sufficient amount of the developer is carried to the developing zone 535 by the roller 532 of the developing roller 53. Also, the rubbing action of the peripheral surface of the roller 532 on the peripheral surface of the photoconductor drum 42 properly peels off the developer that has once adhered to the non-image area of the latent electrostatic image. Hence, a satisfactory image having an appropriate development density and free from fog can be obtained. The developer after use that has passed through the developing zone 535 while being held on the peripheral surface of the roller 532 constituting the developing roller 53, on the other hand, is passed on to the surface of the makeup roller 54 at the nip between the developing roller 53 and the makeup roller 54. The peripheral speed of the makeup roller 54 is set to be greater than the peripheral speed of the developing roller 53. Therefore, as the developer is shifted to the makeup roller 54 at the nip, the non-transferred developer adhering to the developing roller 53 during passage through the developing zone 535 can be decreased in adherence, and recovered. Hence, a ghost ascribed to the non-transferred developer adhering to the developing roller 53 can be prevented.

The process unit according to the present invention has been described based on the embodiments in which it is applied to a printer. However, the present invention is in no way limited to the illustrated embodiments, and various changes or modifications are possible without departing from the scope of the technical concept of the invention. In the above-described embodiments, for example, the first imaging unit is the photoconductor unit 40, and the second imaging unit is the developing unit 50. Even if the second imaging unit is a cleaning unit (not shown), however, the present invention holds. That is, the present invention holds as long as its process unit includes at least two imaging units which are supported via the support shaft means so as to be pivotable relative to each other.

According to the process unit constructed by the present invention, the first imaging unit and the second imaging unit can be assembled highly efficiently, and their assembly is firm and rattle-free.

What we claim is:

1. A process unit including a first imaging unit, a second imaging unit, and support shaft means for supporting the first imaging unit and the second imaging unit pivotably relative to each other; wherein the first imaging unit and the second imaging unit each have a pair of support side walls arranged with spacing and provided with support holes having a common axis, one pair of the support side walls define a pair of inner support side walls having an outside width smaller than the inside width of the other pair of the support side walls, while the other pair of the support side walls define a pair of outer support side walls, the support shaft means includes a support shaft composed of a rod member circular in section, and having a larger diameter portion, and having at one end part a smaller diameter portion continued from the larger diameter portion via a stepped portion; and a bearing member having a tubular portion provided with a support hole having an open end and a closed end, said bearing member being detachably mounted on one of the outer support side walls by the fitting of the tubular portion into the support hole of the one of the outer support side walls, and with the bearing member being mounted on the one of the outer support side walls, the respective support holes of the inner support side walls are fitted with the larger diameter portion of the support shaft, the support hole of the other of the outer support side walls is fitted with the smaller diameter portion of the support shaft, the support hole of the bearing member is fitted with the other end part of the support shaft, the outside surface of one of the inner support side walls is contacted with the inside surface of the other of the outer support side walls, the outside surface of the other of the inner support side walls is contacted with the open end of the bearing member or the inside surface of the one of the outer support side walls, the stepped portion of the support shaft is contacted with the inside surface of the other of the outer support side walls, and the end face of the other end part of the support shaft is positioned apart from the closed end of the bearing member.

2. A process unit as claimed in claim 1, wherein the other end part of the support shaft is positioned in the support hole of the one of the outer support side walls via the tubular portion of the bearing member.

* * * * *